US009068362B1

(12) United States Patent
Baxter et al.

(10) Patent No.: US 9,068,362 B1
(45) Date of Patent: Jun. 30, 2015

(54) SIDING PANEL WITH INTERLOCK

(71) Applicant: Ply Gem Industries, Inc., Cary, NC (US)

(72) Inventors: L. Rex Baxter, Excelsior Springs, MO (US); John M. Wade, Pleasant Hill, MO (US); Brent A. Dilonardo, Liberty, MO (US)

(73) Assignee: Ply Gem Industries, Inc., Cary, NC (US)

( * ) Notice: Subject to any disclaimer, the term of this patent is extended or adjusted under 35 U.S.C. 154(b) by 0 days.

(21) Appl. No.: 14/307,086

(22) Filed: Jun. 17, 2014

(51) Int. Cl.
*E04D 1/00* (2006.01)
*E04F 13/24* (2006.01)
*E04F 13/08* (2006.01)

(52) U.S. Cl.
CPC ..... *E04F 13/24* (2013.01); *E04F 13/0894* (2013.01)

(58) Field of Classification Search
CPC ..... E04F 13/24; E04F 13/0894
USPC ..... 52/520, 521, 522, 545
See application file for complete search history.

(56) References Cited

U.S. PATENT DOCUMENTS

| | | | | | |
|---|---|---|---|---|---|
| 3,325,952 | A * | 6/1967 | Trachtenberg | 52/276 |
| 4,186,538 | A * | 2/1980 | Marcum, Jr. | 52/521 |
| 4,187,661 | A * | 2/1980 | Poiry | 52/748.11 |
| 4,308,702 | A * | 1/1982 | Rajewski | 52/519 |
| 4,334,396 | A * | 6/1982 | Hagopian | 52/522 |
| 4,930,287 | A * | 6/1990 | Volk et al. | 52/748.11 |
| 5,806,185 | A * | 9/1998 | King | 29/897.32 |
| 5,916,095 | A * | 6/1999 | Tamlyn | 52/58 |
| 6,363,676 | B1 * | 4/2002 | Martion, III | 52/519 |
| 7,739,847 | B2 * | 6/2010 | Griman | 52/519 |
| 7,784,222 | B2 * | 8/2010 | Bennett | 52/58 |
| 8,555,582 | B2 * | 10/2013 | Mollinger et al. | 52/302.4 |
| 2005/0081468 | A1 * | 4/2005 | Wilson et al. | 52/528 |
| 2006/0075712 | A1 * | 4/2006 | Gilbert et al. | 52/520 |

* cited by examiner

*Primary Examiner* — Basil Katcheves
(74) *Attorney, Agent, or Firm* — Lathrop & Gage LLP

(57) ABSTRACT

An interlocking siding panel comprising an upper lock portion, wherein the upper lock portion further comprises a riser segment contiguous with the back face of the panel. The riser segment transitions to a bend fully reversing direction to form a nail hem segment. The nail hem segment terminating at a first bend leading to a first riser leg transitioning to a planar segment through a second bend. The planar segment terminating at a third bend leading to a second riser leg that terminates at a fourth bend forming the proximal end of a locking leg; a front face; a back face; and a lower lock portion disposed laterally opposite the upper lock portion. The lower lock portion further comprising a lower flange and a return leg, wherein in operation the return leg of the lower portion of a first panel is inserted beneath the proximal end of the locking leg.

26 Claims, 4 Drawing Sheets

SIDING PANEL WITH INTERLOCK

FIELD

This disclosure pertains in general to a composite exterior siding panel that includes a system for interlocking panels. The disclosure also details how the system of interlocking panels limits the ability of wind to undermine the panels creating pressure differentials on the front and back surface that can dislodge the panel from the structure.

BACKGROUND

Siding panels serve a two-fold objective of protecting a structure from damaging elements such as sunlight, moisture, hail and strong winds as well as providing an aesthetically appealing external appearance to the structure. The siding must be capable of protecting the structure from blisteringly hot sunlight that can induce thermal expansion and unattractive buckling of the siding. Panel siding must also minimize the infiltration of moisture from heavy wind-blown rains and should moisture find its way behind the siding an exit route must be available to avoid the growth of mold and to prevent the rotting of any cellulosic structural elements such as plywood siding and structural framing or the oxidation of ferrous support members.

In addition to the capacity to withstand thermal loading, hail impacts and provide an escape route for moisture, well designed and installed exterior siding must be capable of withstanding high wind loadings. Siding panels that allow wind to gain access to the back surface, or the surface adjacent to the building structure, can experience tremendous loads capable of literally peeling the siding from the building. Consequently, the ability to seal both the upper and lower edges of the siding panel against panel courses above and below is critical to protecting the panels from the effects of strong wind loads.

Numerous siding panel designs exist in the market place; however, most are either lacking in some functional aspect or are prohibitively expensive, difficult to install or require extensive training and costly tools for proper installation. The consequence of such involved training and the acquisition of expensive tools is that these costs must ultimately be passed onto the consumer in order for the installer to experience a profit from her labors.

The product disclosed herein overcomes the adversities posed by wind, hail, rain, sun and complex installation procedures with a simple design that requires little training or sophisticated tools to properly install. In addition, the handsome wood grain exterior surface is aesthetically appealing with the warm textured feel of natural wood yet produced from a thermoplastic material that is highly resistant to fading, chipping, moisture damage, cracking and damage by insects.

It is an object of the invention to provide an engineered plastic exterior siding panel that is thermally stable and that will not buckle or warp even under the most extreme solar heat loads.

It is another object of the invention to provide an aesthetically appealing exterior surface that replicates a natural wood grain.

It is another object of the invention to provide a thermoplastic exterior siding panel that is lightweight and easy to install by an untrained homeowner with standard tools.

It is another object of the invention to provide an exterior siding panel that is tough, durable and capable of withstanding impacts from, for example, large diameter hail.

It is another object of the invention to provide an exterior siding panel that includes a locking leg extending rearwardly from the back face of the panel and that also extends nominally downwardly toward the bottom edge of the panel and that extends longitudinally along the entire length of the panel. The locking leg creates a pocket for insertion of the top edge of a second panel disposed below the first panel to precisely define the positional relationship between the first and second panels.

SUMMARY

The composite exterior siding panel with interlock system disclosure is directed to a panel capable of protecting a structure from damaging elements such as sunlight, moisture, hail and strong winds as well as providing an aesthetically appealing external appearance to the structure. In a preferred embodiment the siding panel comprises an extruded composite material of polyvinyl chloride that is durable, resistant to mold growth and resistant to deformation from impacts by hail and other hard objects.

The disclosed siding panel comprises a panel with a front face and a back face along with a top edge and a bottom edge. As is typical with siding panels, the panel course above partially overlaps the panel course below and the description below effectively outlines a system for building multiple courses of panels stacked atop and interlocking with one another on the side of a building.

The disclosed siding panel also includes a top portion of the panel and a bottom portion, the top and bottom portions of the panel diverge from one another at an inflection point. These diverging panel portions facilitate the formation of a path for moisture to travel between panel courses as will be discussed in greater detail below. The disclosed siding panel includes a flange extending substantially perpendicularly from the back face of the panel adjacent the bottom edge as well as a locking leg with a flat pad. The flange and locking leg with a flat pad run longitudinally along the entire length of the panel as do all features described below unless otherwise noted.

The locking leg backside in concert with the back face of the panel form a pocket for insertion of the top edge of a separate panel positioned in a lower panel course. The composite panel also includes a nail strip extending longitudinally along the entire front face of the panel proximate the top edge of the panel to be used in securing the panel to the wall with nails, screws and other securement means. The panel also includes a full contact strip extending longitudinally along the entire back face of the panel proximate the top edge of the panel which serves as the panel's only longitudinally extending area of contact with the wall surface.

After the first course of paneling is applied to the structure the pocket formed by the locking leg backside and the back face of the panel on the second course is positioned over the top edge of the first panel secured to the structure. Once the top edge of the first panel is positioned within the locking leg pocket of the second course, the second course is secured to the structure through the nail strip causing the full contact strip to lay flat against the structure. When a panel is secured to the structure at the full contact strip the entire back face of the panel below the inflection point, including the flat pad of the locking leg, raises off of the structure. Since no features of the back side of the panel below the inflection point are in contact with the wall surface an unobstructed path is created for moisture to flow downward with the aid of gravity.

Once moisture reaches the next lowest panel course it encounters the bottom edge of the first flat proximate the top edge of the panel where weep slots are installed to further facilitate the movement of moisture downward. The weep slots are installed with a separation distance of between 3 and 16 inches with a preferred diameter of about 3/16 inch. The weep slots originate proximate the bottom edge of the first flat and extend past the inflection point thereby allowing moisture to travel past the full contact strip which is firmly pressed against the wall by nails or screws passing through the nail strip. Failing to include weep slots would cause moisture to pool atop the first flat thereby potentially contributing to deterioration of the wall structure due to mold growth or structural member damage. Additionally, without weep slots moisture could become trapped behind the panel during a freeze thaw cycle thereby causing the moisture to expand and push the panels away from the structure loosening the connection to the building.

An additional feature of the disclosed panel is a flange extending substantially perpendicularly from the back face of the panel adjacent the bottom edge. When a second and further courses are installed the flat of the panel flange positioned above lands squarely and firmly on the front face of the lower panel course. The flange serves an aesthetic purpose of simulating a real wood panel that has sufficient thickness to overlap the panel course positioned below. Additionally, the flange serves to limit the intrusion of both high speed winds and wind-blown moisture. High speed winds that enter beneath the bottom edge of panels that are not secured at the nail strip can catastrophically peel one or many panels from the wall surface. The flange effectively provides a wind and rain shield keeping the elements from intruding behind the panels and allowing the front face of the panel to provide protection for the structure.

Various objects, features, aspects and advantages of the inventive subject matter will become more apparent from the following detailed description of preferred embodiments, along with the accompanying drawing in which like numerals represent like components.

DETAILED DESCRIPTION

Figure 1:
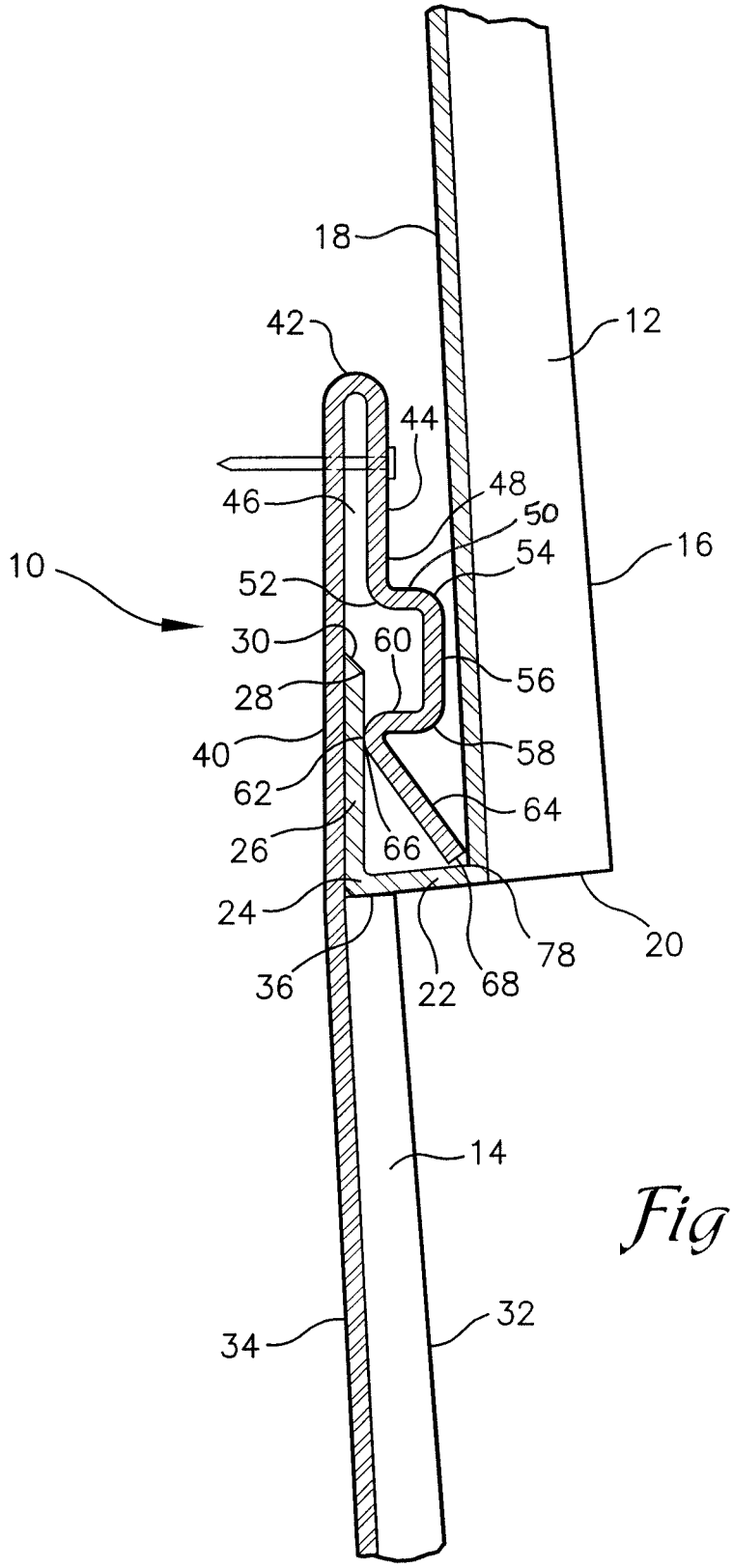
FIG. 1 is a side elevation view of an embodiment of a lower portion of a first panel interlocked with an upper portion of a second panel.

FIG. 1 depicts a side elevation view of an embodiment of a siding panel locking system 10 with an upper panel 12 engaged with a lower panel 14. Each panel member 12, 14 is considered a "course" of paneling. Courses of paneling are placed adjacent one another and, as desired by the owner or installer, cover a portion of or the entire structure. The upper panel 12 has a textured front face 16, a back face 18 and a lower edge 20. Running from the lower edge 20 rearwardly in the direction of the back face 18 is a lower flange 22. The lower flange 22 extends behind the back face 18 of the panel 12 and then abruptly turns upward at a corner 24 to form a return leg 26. The return leg 26 terminates at an edge 28 with a chamfer 30 that is instrumental in easing the engagement of the upper and lower panels 12, 14.

The lower panel 14 includes a textured front face 32, a back face 34 and an upper ledge 36 against which rests the lower flange 22 of the upper panel 12 when the panels are installed against a building structure. A riser segment 40 extends upwardly from the back face 34 of the siding panel 14. The riser segment 40 traverse terminates at a bend 42 which fully reverses the direction of the riser segment 40 to form a nail hem segment 44. The arcuate bend 42 maintains a gap 46 between the riser segment 40 and the nail hem segment 44. The front face of the nail hem segment is the nail hem face 48 and it is against this nail hem face 48 that the head of a nail or screw used by the installer will be disposed.

As the nail hem segment 44 extends downwardly, the nail hem segment 44 terminates at a first riser segment 50. The first riser segment 50 turns approximately 90 degrees at a bend 52 and when installed on a structure, the first riser segment 50 extends toward the back face 18 of the upper panel 12. The first riser segment 50 terminates at a second 90 degree bend 54 and extends into a planar segment 56 that runs roughly parallel with the back face 18 of the adjacent panel 12. The planar segment 56 spans a limited distance before again terminating at a third bend 58. The third bend 58 is also roughly 90 degrees and extends into a second riser segment 60. The second riser segment 60 turns parallel to the first riser segment 50 and extends away from the back face 18 of the upper panel 12. The second riser segment 60 terminates into a fourth bend 62. The fourth bend 62 merges into a locking leg 64 that extends upwardly toward the back face 18 of the upper panel 18 at an angle in the range of 30 to 40 degrees relative to the riser segment 40. A second gap 66 exists between the fourth bend 62 and the return leg 26 that is preferably of a lesser width than the thickness "T" of the return leg 26. The basis for this preferred thickness "T" is to engage and hold firmly the return leg 26 when the return leg of the upper panel is inserted into the second gap 66 of the lower panel. The locking leg 64 extends only nominally above the top surface 66 of the planar segment 56 and terminates with a flat end 68.

Figure 2:
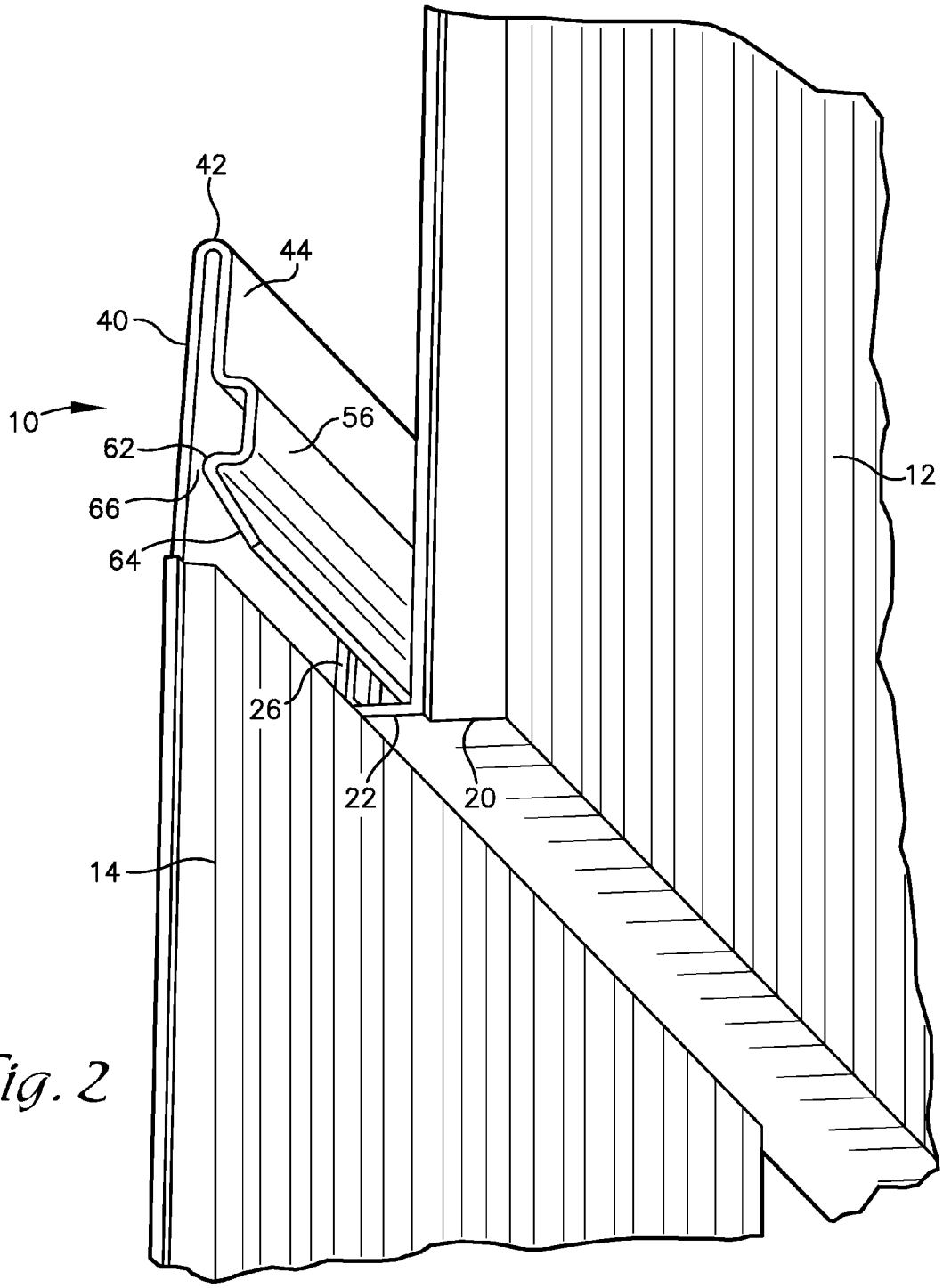
FIG. 2 is a perspective view of an engagement between an upper panel and a lower panel.

FIG. 2 depicts a perspective view of an upper panel 12 undergoing engagement with a lower panel 14. In this depiction, the return leg 26 of the upper panel 12 is inserted into the locking system 10 of the lower panel 14. This figure details the positioning of the lower flange 22 atop the upper ledge 36 of the lower panel 14. FIG. 2 depicts only a segmented potion of the engaged panels 12, 14; however, it should be understood that the panels are longitudinal and may be of a variety of lengths including a standard 8 foot 4 inch length. Consequently, the various components discussed above, including the locking leg, nail hem and return leg to name just a few, extend the entire length of the panel and are not limited to some lesser length.

Figure 3:
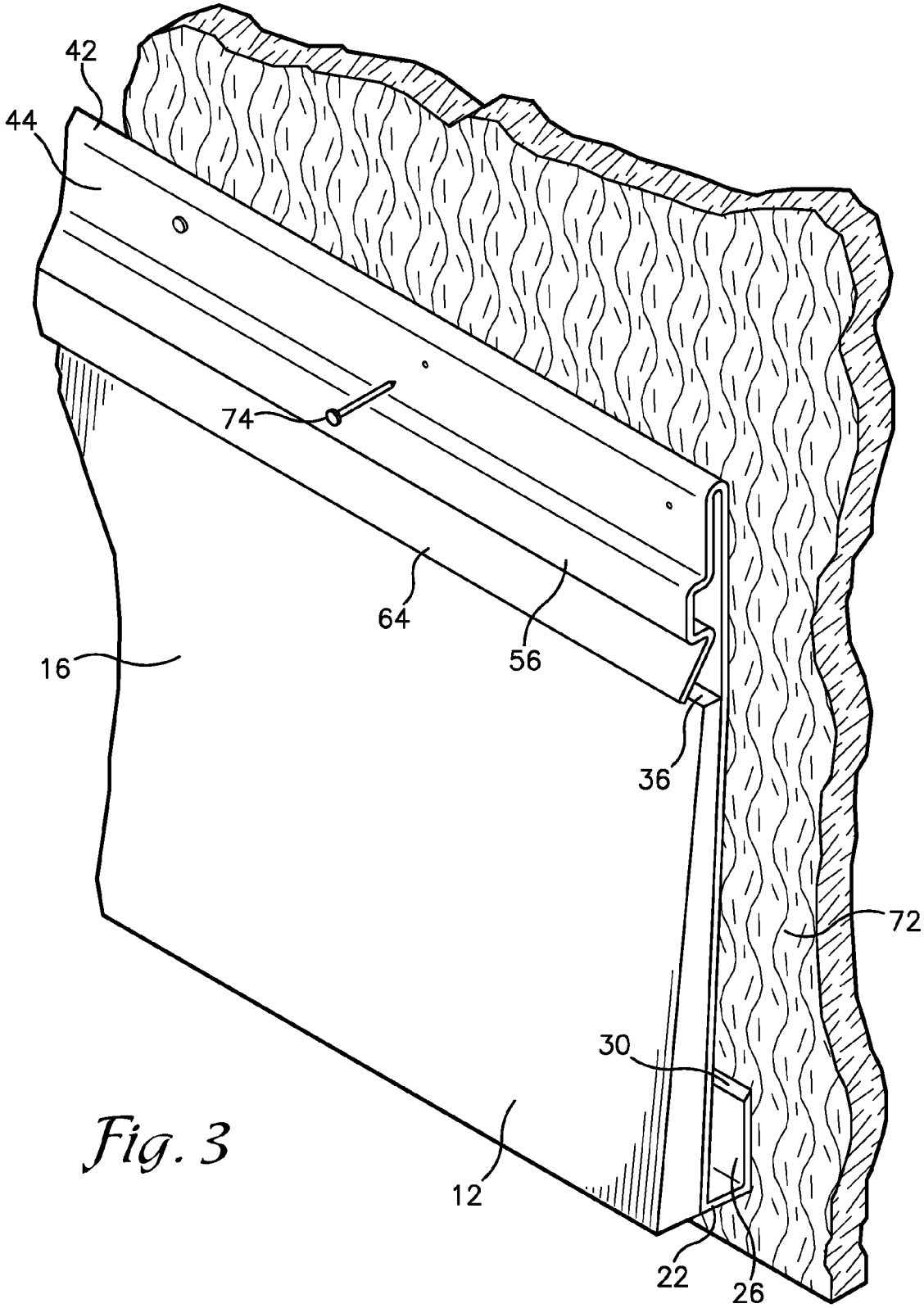
FIG. 3 is a perspective view of an embodiment of a single siding panel being secured to a structure with an attachment device.

As shown in FIG. 3, the panel 12 is secured to a building surface 72 at the nail hem 44 typically by insertion of nails 74, or alternatively screws (not shown), through elongated slots (not shown) in the hem 44. Slot, as opposed to holes, tend to better accommodate thermal expansion of the panels and prevent buckling of the panels due to thermal stresses.

Figure 4:
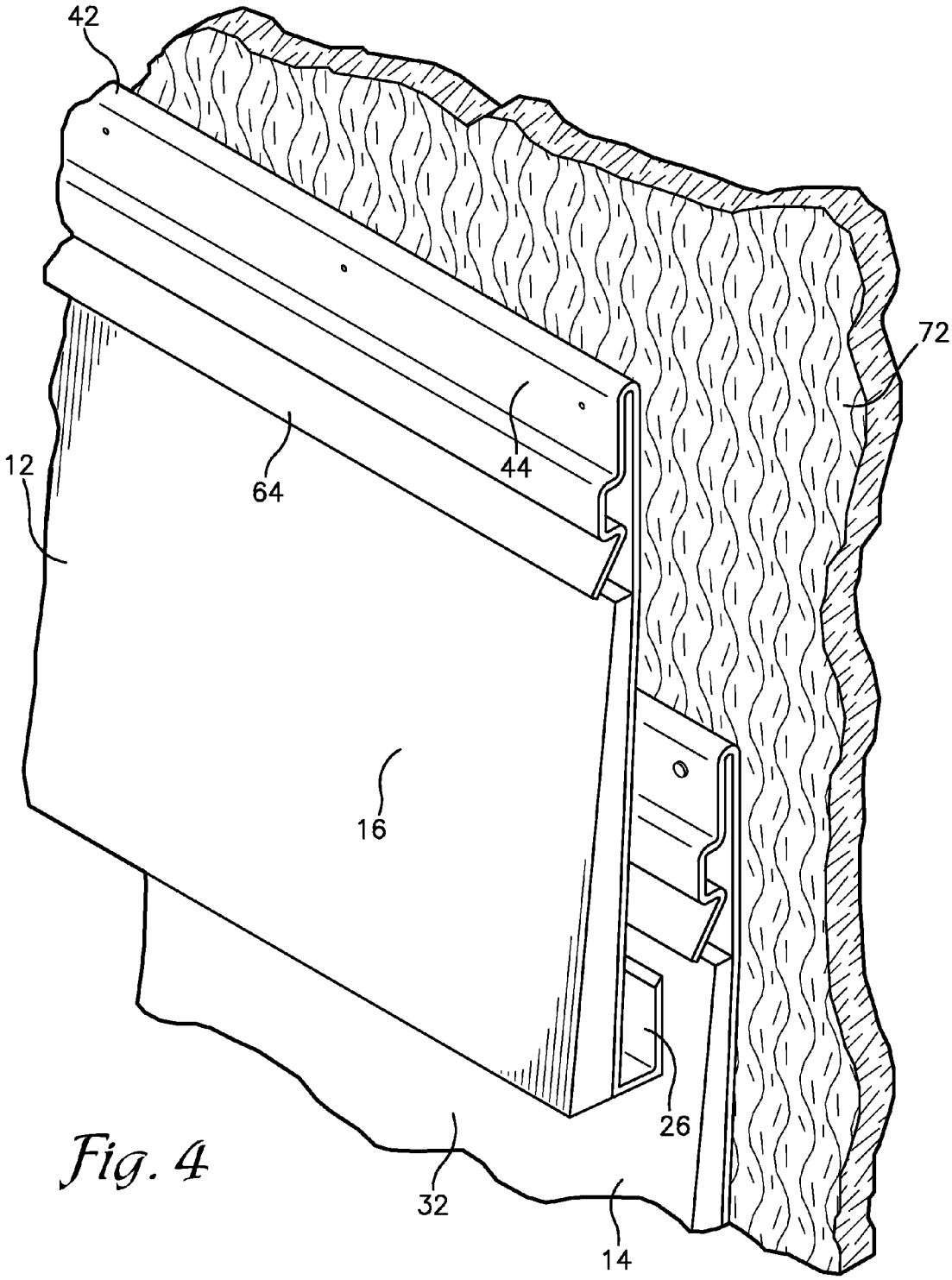
FIG. 4 is a perspective view of a first siding panel embodiment secured to a structure with an approaching second siding panel embodiment about to engage the first siding panel.

FIG. 4 depicts the placement of a second panel 12 above the lower panel 14 in preparation for insertion of the return leg 26 into the locking system 10. The chamfered edge 30 at the end of the return leg 26 facilitates the entry of the return leg beneath the fourth bend 62. The chamfered edge 30 serves to lift the locking leg 64 and the second riser segment 60. Because the gap 66 is of a lesser thickness than the thickness "T" of the return leg 26, the elastic nature of the panel materials causes pressure to be applied to the return leg 26 as it is inserted beneath the fourth bend 62. When the return leg 26 is fully in position in the locking assembly the pressure applied along the longitudinally extending fourth bend 62 continues to be applied and can therefore limit the prospect of float of the lower portion upper panel member 12. Float occurs when strong winds move across the surface of the panel and create a region of lower pressure on the panel seeking to strip the panel from the structure to which it is secured. Without pressure being applied along the fourth bend 62, the lower portion of the upper panel 12 such as the return leg 26, because of the reduced pressure, could move away from the riser segment 40. Even a slight departure from contact with the riser segment 40 could allow strong winds to move beneath the riser leg and rip the panel from the structure to which it is secured. Consequently, the pressure applied by the fourth bend is critical to the functionality of the panel design.

In operation, as seen in FIG. 3, a lower course of paneling 14 is secured to a structure 72. The panel 12 is secured to a wall with nails 74, or screws, through the nail hem segment 44. The insertion of the nails or screws into the nail hem will cause the gap 46 between the nail hem 44 and the riser segment 40 to narrow. Likewise, the gap 66 between the fourth bend 62 and the riser segment 40 will also narrow or may completely disappear. Once the lower panel 14 is secured to the wall 72 the upper course of paneling 12 is moved adjacent to the lower course 14. The return leg 26 of the upper panel 12 is slid between the fourth bend 62 and the riser segment 40 until the lower flange 22 of the upper panel 12 rests atop the upper ledge 36 of the lower panel 14. When fully installed, the locking leg 64 of the lower panel will be positioned adjacent the internal corner 78 of the back face 18 of the upper panel 12. The end 68 of the locking leg 64 interferes with the internal corner and is therefore pushed back against the fourth bend 62. This load, or pressure, is transferred back to the fourth bend 62 and further increases the load applied along the fourth bend 62 to the return leg 26. When engaged with the next course of paneling the distal end of the locking leg applies a force in the range of 0.5-10 pounds per linear foot along the return leg of the adjacent upper panel member. A specific force per linear foot is consistent along any single panel and can be modified during the manufacturing process to obtain a lesser or greater force per linear foot depending upon the manufacturer's preference. This load is determined by the force necessary to retract the distal end of the locking leg from contact with the return leg.

While the preferred form of the present invention has been shown and described above, it should be apparent to those skilled in the art that the subject invention is not limited by the figures and that the scope of the invention includes modifications, variations and equivalents which fall within the scope of the attached claims. Moreover, it should be understood that the individual components of the invention include equivalent embodiments without departing from the spirit of this invention.

We claim:

1. An interlocking siding panel, the interlocking siding panel comprising:

a front face;

a back face;

an upper lock portion, wherein the upper lock portion further comprises a riser segment contiguous with the back face of the panel, the riser segment transitioning into a bend fully reversing direction to form a nail hem segment, the nail hem segment terminating at a first bend leading to a first linear riser leg that transitions to a planar segment through a second bend, the planar segment terminating at a third bend leading to a second linear riser leg that terminates at a fourth bend forming a proximal end of a locking leg; and a lower lock portion disposed laterally opposite the upper lock portion, the lower lock portion further comprising a lower flange and a substantially linear return leg;

wherein:

in operation the return leg of the lower portion of a first panel is inserted beneath the proximal end of the locking leg of a second panel; and the angle of the fourth bend is such that the locking leg extends downwardly and away from the fourth bend at an angle in the range of 30 to 40 degrees relative to the riser segment.

2. The interlocking panel of claim 1, wherein a first gap exists between the riser segment and the nail hem.

3. The interlocking panel of claim 2, wherein the first gap is in the range of from 0.01 to 0.10 inches.

4. The interlocking panel of claim 1, where the locking leg has a distal end opposite the proximal end.

5. The interlocking panel of claim 4, wherein when engaged with the next course of paneling the distal end of the locking leg contacts the back face of the adjacent panel.

6. The interlocking panel of claim 4, wherein when engaged with the next course of paneling there exists no gap between the distal end of the locking leg and return leg.

7. The interlocking panel of claim 6, wherein when engaged with the next course of paneling the distal end of the locking leg applies a consistent force along the return leg of an upper panel member.

8. The interlocking panel of claim 7, wherein when vertically adjacent panels are interlocked the lower flange of the upper panel rests atop the upper ledge of the lower panel.

9. The interlocking panel of claim 1, wherein a second gap exists between the proximal end of the locking leg and the riser segment.

10. The interlocking panel of claim 9, wherein the second gap is in the range of from 0.01 to 0.10 inches.

11. The interlocking panel of claim 1, wherein the front face of the panel proximate the upper lock portion terminates in an upper ledge.

12. The interlocking panel of claim 1, wherein the front face of the panel proximate the lower lock portion terminates in a lower flange.

13. The interlocking panel of claim 1, wherein when engaged with the next course of paneling a gap exists between the planar segment and the back face of the upper panel member.

14. A system for interlocking to one another vertically separated courses of siding panels, the interlocking panel system comprising:

a first and second panel each with, a) a front face with an upper ledge;

b) a back face;

c) an upper lock portion further comprising a riser segment contiguous with the back face of the panel, the riser segment transitioning into a bend fully reversing direction to form a nail hem segment, the nail hem segment terminating at a first bend leading to a first linear riser leg that transitions to a planar segment through a second bend, the planar segment terminating at a third bend leading to a second linear riser leg that terminates at a fourth bend forming the proximal end of a locking leg; and d) a lower lock portion disposed laterally opposite the upper lock portion, the lower lock portion further comprising a lower flange and a return leg, wherein the angle of the fourth bend is such that the locking leg extends downwardly and away from the fourth bend at an angle in the range of 30 to 40 degrees relative to the riser segment; and wherein, in operation, the return leg of the lower portion of the second panel is inserted beneath the proximal end of the locking leg of the first panel and the lower flange of the second panel is disposed atop the upper ledge of the first panel.

15. The system of claim 14, wherein a first gap exists between the riser segment and the nail hem.

16. The system of claim 15, wherein the first gap is in the range of from 0.15 to 0.35 inches.

17. The system of claim 14, where the locking leg has a distal end opposite the proximal end.

18. The system of claim 17, wherein, when engaged, the distal end of the locking leg of the first panel contacts the back face of the second panel.

19. The system of claim 17, wherein, when engaged, no gap exists between the distal end of the locking leg of the first panel and the return leg of the second panel.

20. The system of claim 19, wherein, when engaged, the distal end of the locking leg of the first panel applies a consistent force along the return leg of the second panel.

21. The system of claim 14, wherein a second gap exists between the proximal end of the locking leg and the riser segment.

22. The system of claim 21, wherein the second gap is in the range of from 0.15 to 0.35 inches.

23. The system of claim 14, wherein the front face of the panel proximate the upper lock portion terminates in an upper ledge.

24. The system of claim 14, wherein the front face of the panel proximate the lower lock portion terminates in a lower flange.

25. The system of claim 14, wherein when the first and second panels are interlocked the lower flange of the second panel rests atop the upper ledge of the first panel.

26. The system of claim 14, wherein, when engaged, a gap exists between the planar segment of the first panel and the back face of the second panel.

* * * * *